United States Patent [19]

Gotisar et al.

[11] Patent Number: 5,049,786

[45] Date of Patent: Sep. 17, 1991

[54] HIGH ENERGY IGNITOR POWER CIRCUIT

[75] Inventors: Ted Gotisar; Ronald J. Jensen, both of Pacifica, Calif.

[73] Assignee: Coen Company, Inc., Burlingame

[21] Appl. No.: 565,072

[22] Filed: Aug. 9, 1990

[51] Int. Cl.[5] ..... H05B 41/36

[52] U.S. Cl. ..... 315/209 CD; 315/209 T; 315/209 SC; 123/596

[58] Field of Search ..... 315/209 CD, 209 R, 209 T, 315/209 SC, 240, 362; 123/596, 597, 598, 618, 620; 361/253, 256, 257; 313/11:5, 11.8, 125, 126, 141, 143

[56] References Cited

U.S. PATENT DOCUMENTS

| | | | |
|---|---|---|---|
| 3,470,386 | 9/1969 | Potts et al. | 361/253 |
| 3,666,989 | 5/1972 | Boyer | 315/219 |
| 3,714,507 | 1/1973 | Schweitzer et al. | 123/148 |
| 3,731,143 | 5/1973 | Thakore | 315/209 |
| 3,835,350 | 9/1974 | Thakore | 315/209 |
| 3,900,017 | 8/1975 | Collins | 123/148 |
| 4,027,198 | 5/1977 | Linkroum | 315/209 |
| 4,083,347 | 4/1978 | Grather et al. | 123/148 |
| 4,345,575 | 8/1982 | Jorgensen | 123/598 |
| 4,407,259 | 10/1983 | Abo | 123/620 |
| 4,589,398 | 5/1986 | Pate et al. | 123/596 |
| 4,619,241 | 10/1986 | Yoshinori | 123/620 |
| 4,833,369 | 5/1989 | White | 315/209 |
| 4,915,079 | 4/1990 | Holmes | 123/419 |

OTHER PUBLICATIONS

Elec. Eng. Ref. Book; Butterwor (14th ed. '85), Sec. 5.6.5.

*Primary Examiner*—Eugene R. Laroche
*Assistant Examiner*—Ali Neyzari
*Attorney, Agent, or Firm*—Townsend and Townsend

[57] ABSTRACT

A constant energy, constant spark rate ignitor system suitable for use in high energy ignition systems. The ignitor system includes a vacuum interrupter switch through which an energy storage capacitor discharges to fire a surface gap spark plug. Discharge of the energy storage capacitor through the vacuum interrupter can only occur upon actuation of the switch. The quantity of energy stored in the energy storage capacitor and the timing of capacitor discharge is therefore not a function of ambient operating conditions or the dielectric properties of the switch and can therefore be independently controlled. A voltage comparator and spark rate clock are used to trigger closure of the vacuum interrupter switch and fire the plug when the capacitor contains the desired quantity of energy and a clock signal is present. A current proving circuit is also provided to verify that current passes through the spark plug.

28 Claims, 6 Drawing Sheets

| CONDITION | $V_{REF}$ FOR: |
|---|---|
| ALL OPEN | 10 JOULE |
| 154 CLOSED | 14 JOULE |
| 156 CLOSED | 12 JOULE |
| 158 CLOSED | 8 JOULE |

HIGH ENERGY IGNITOR POWER CIRCUIT

BACKGROUND OF THE INVENTION

This invention relates to high energy ignition circuits for igniting a fuel. Such ignitor circuits are frequently employed in power plants, steam generation boilers, jet engine ignition and other combustion engineering applications. To ensure that the fuel ignition is achieved, these applications require that the ignition circuit provide a spark at a spark rate and energy level sufficient ignition of the fuel. An uneven spark rate may prevent reliable ignition. In severe cases, uneven spark rates cannot obtain ignition of the fuel.

FIG. 1 shows a block diagram of a conventional high energy ignitor circuit. The typical high energy ignition circuit consists of one or more capacitors 10 that are charged from a direct current (DC) power source 12 through a series resistor 14. Capacitor(s) lo is coupled to a spark gap tube 20 which is in turn coupled to a spark plug 21. Capacitor 10 is charged exponentially by DC power source 12 until the breakdown voltage of spark gap 20 is obtained. At the breakdown voltage threshold of the spark gap, energy is transported across the electrodes and fires the surface gap spark plug.

Conventional ignitor circuits may also contain a monitoring circuit 22 to verify that plug 21 is being fired. The monitoring circuit allows for the prevention of a fuel valve opening with a disfunctioning ignitor circuit. Unignited fuel presents a serious safety hazard; proof of ignition energy is often required by safety codes.

FIG. 2 shows a cut away view of a conventional spark gap tube 20 used in the typical ignitor system described above. Spark gap tube 20 consists of two electrodes, 23 and 24 located within a housing 26 formed of glass or ceramic material. The interior 28 of housing 26 is a controlled environment of an inert gas. Electrodes 23 and 24 are separated a given distance, forming a gap 30. At a predetermined potential energy, current passes from electrode 23 to electrode 24 as arc 32.

FIG. 3 contains a graph of gap breakdown voltage versus pressure. As is evident from curve 34, the breakdown voltage for a given gap is not constant but varies with pressure, and thus temperature. Because interior 28 of spark gap tube 20 is not vacuous, the breakdown voltage is finite and varies across a range of operating conditions.

Use of a spark gap tube therefore imposes several limitations on the typical high energy ignitor system described above. First, the capacitor discharge voltage is not independently variable, but is fixed by the breakdown voltage of the spark gap tube. The breakdown voltage of the spark gap, however, is not constant and varies with pressure and temperature as well as cycles of use. The discharge energy of capacitor 10, therefore, must also vary as a function of temperature, contact erosion, gas 28 contamination, and self-heating, independently of the energy requirements for fuel ignition. To ensure sparking, capacitor 10 must be sized large enough to provide sufficient energy for all environmental conditions and is thus sized to account for variations in the operating characteristics of spark gap tube 20. This fact imposes a design constraint which makes it difficult to optimize capacitor 10.

In addition to governing the size of capacitor 10, the breakdown voltage of spark gap tube 20 fixes the discharge energy of capacitor 10 and prevents independent variation of the discharge energy to respond to changing uses or conditions. For example, the voltage required to fire a spark plug increases in proportion to the number of firings to which the plug has been subjected. To account for these variations over the life of the plug, the gap breakdown voltage and capacitor discharge energy of most ignitor circuits are set at an energy level sufficient to fire a high cycle plug. This same energy level is applied to all plugs no matter how many firing cycles the plug has actually endured and thus in disregard of the true energy requirements of the plug. This practice increases system energy costs and may accelerate plug wear.

A second limitation of the typical ignitor system relates to control of the spark rate. The capacitor of the typical system will fire whenever the breakdown voltage of the gap is reached. Therefore, the spark rate will be governed by the time necessary to charge the capacitor to the breakdown voltage level. The firing rate of the circuit will thus vary according to changes in the spark gap breakdown voltage. Furthermore, line voltage variations can cause fluctuations in the time necessary for power supply 12 to charge capacitor 10 to the breakdown voltage gap of 30 of spark gas tube 20. These fluctuations in the output of DC power source 12 will affect the spark rate unless expensive voltage regulators are used to regulate DC power source 12.

A third limitation of the typical circuit stems from the fact that when the spark plug fires, the length of time that current flows through the spark plug circuit is very short, typically 50 microseconds. This short time period makes it impractical to directly operate an indicating device such as a relay that would require current for a number of milliseconds. Furthermore, the very low impedance of the spark plug, typically 20 milliohms, would cause the insertion of an indicator device in series with the spark plug to rob most of the energy and reduce the circuit efficiency to an unacceptable level. Conventional designs commonly actuate an indicating device via the voltage drop across timing resistor 14 when the full wave rectified, unfiltered, output of high voltage supply 12 charges energy storage capacitor 10. This circuit suffers the disadvantage that a shorted capacitor 10 will provide the same effect as would the periodic discharge of energy storage capacitor 10 through spark plug 21 via spark gap tube 20, thus providing a false and dangerous indicating of current through the spark plug. Additionally, the relay used as the indicator device is a special type of relay with a delayed drop out characteristic. This special type of relay is less reliable and more expensive than a simple relay.

SUMMARY OF THE INVENTION

The present invention provides a high energy constant spark rate, constant energy ignitor system for use in a multitude of applications. According to one embodiment of the invention, the ignitor system comprises a vacuum interrupter, an electronic control circuit for controlling the operation of the vacuum interrupter and a high voltage DC power supply for charging the energy storage capacitor. The electronic control circuit monitors the voltage present across the terminals of the capacitor. When the voltage reaches a value representing the desired amount of energy, the high voltage power supply is turned off. The vacuum interrupter switch is then activated by the control circuit and the spark plug is fired.

The vacuum interrupter contains a low resistance contact located in an evacuated housing. This switch is more efficient than the spark gap tube of the typical ignitor which relies on plasma discharge. The vacuum environment of the switch also means that the breakdown voltage of the gap between the switch terminals remains infinite, substantially constant, and does not vary with pressure, temperature or other environmental parameters. The discharge energy of the capacitor is therefore not governed by the gap breakdown voltage of the switch terminals. Discharge of the energy storage capacitor occurs only when the vacuum interrupter switch is closed and can thus be independently varied to respond to circuit conditions or changing applications. A voltage comparator tied to a reference voltage comprises one portion of the control circuit which controls charging of the capacitor by the high voltage DC power supply to the predetermined energy level. The control circuit thereby maintains a constant energy level for each discharge of the capacitor.

According to another embodiment of the invention, the electronic control circuit further comprises a spark rate clock. In this embodiment, the control circuit does not engage the vacuum interrupter switch until the capacitor has been charged to the desired energy level and a clock signal is present. In this fashion, the spark rate of the ignitor remains constant without incurring the expense of regulating the power supply. The ignitor system is therefore not subject to AC line voltage variations.

According to yet another embodiment of the present invention, a current proving circuit is provided to sense current in the spark plug wire. This system ensures that the plug has fired and does not rely on inferences made from monitoring the energy storage capacitor charging voltage to detect an unsafe condition. In addition, the current proving circuit of the present invention enables use of a simple relay in lieu of the less reliable and more expensive special relay required in conventional circuits.

DESCRIPTION OF THE SPECIFIC EMBODIMENT

The present invention includes a recognition of the limitations imposed on conventional ignitor circuits by the physics of the spark gap tube. The ignitor system of the present invention employs a vacuum interrupter instead of a spark gap tube to discharge the energy storage capacitor and enables design of a constant energy, constant spark rate ignitor system.

Vacuum Interrupter General Principles

Figure 1:
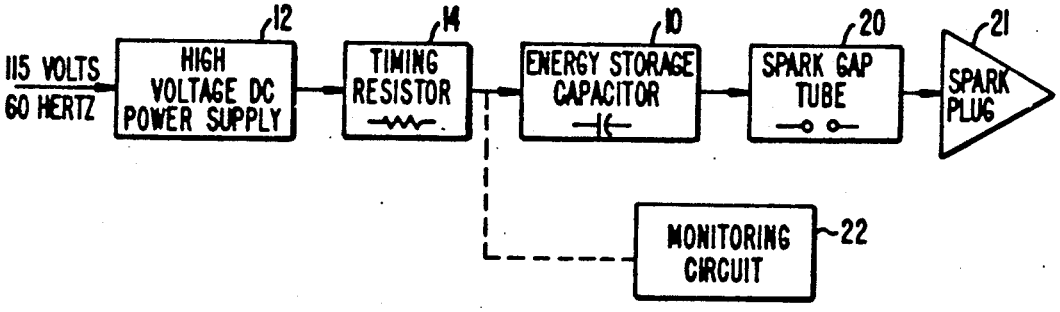
FIG. 1. PRIOR ART
FIG. 1 is a block diagram of a prior art high energy ignitor circuit.
Figure 2:
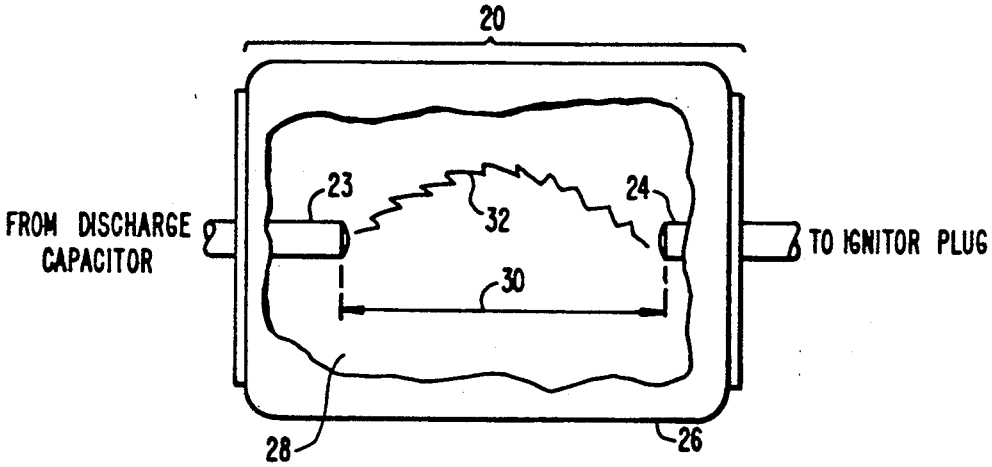
FIG. 2. PRIOR ART
FIG. 2 is a cutaway view of a prior art spark gap tube.
Figure 4:
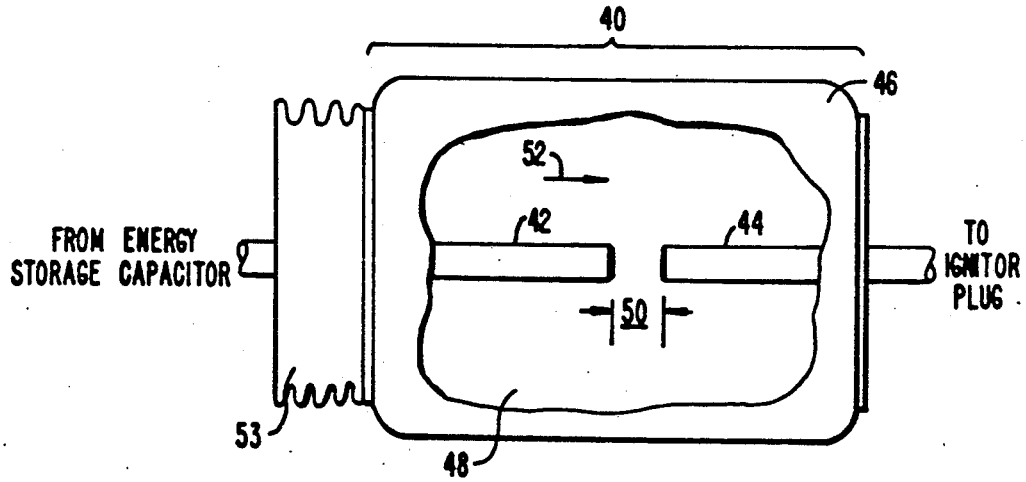
FIG. 4 is a cutaway view of a vacuum interrupter utilized by the present invention.

FIG. 4 is a cutaway view of a vacuum interrupter switch 40. Vacuum interrupter 40 consists of two low resistance contacts 42 and 44, located within a glass or ceramic housing 46. The interior 48 of housing 46 is evacuated. Contacts 42 and 44 are depicted in an open circuit configuration and are separated by a gap 50. Contact 42 is moved in the direction 52 by means of the pressure differential between evacuated interior 48 and the atmosphere pressure exterior to housing 46. Mechanical operation of contact 42 can be controlled independently of conditions within interior 48 of vacuum interrupter 40. A model WL-35082 manufactured by Westinghouse of Pittsburgh, Pa., is an example of a vacuum interrupter suitable for use in the present invention.

Figure 3:
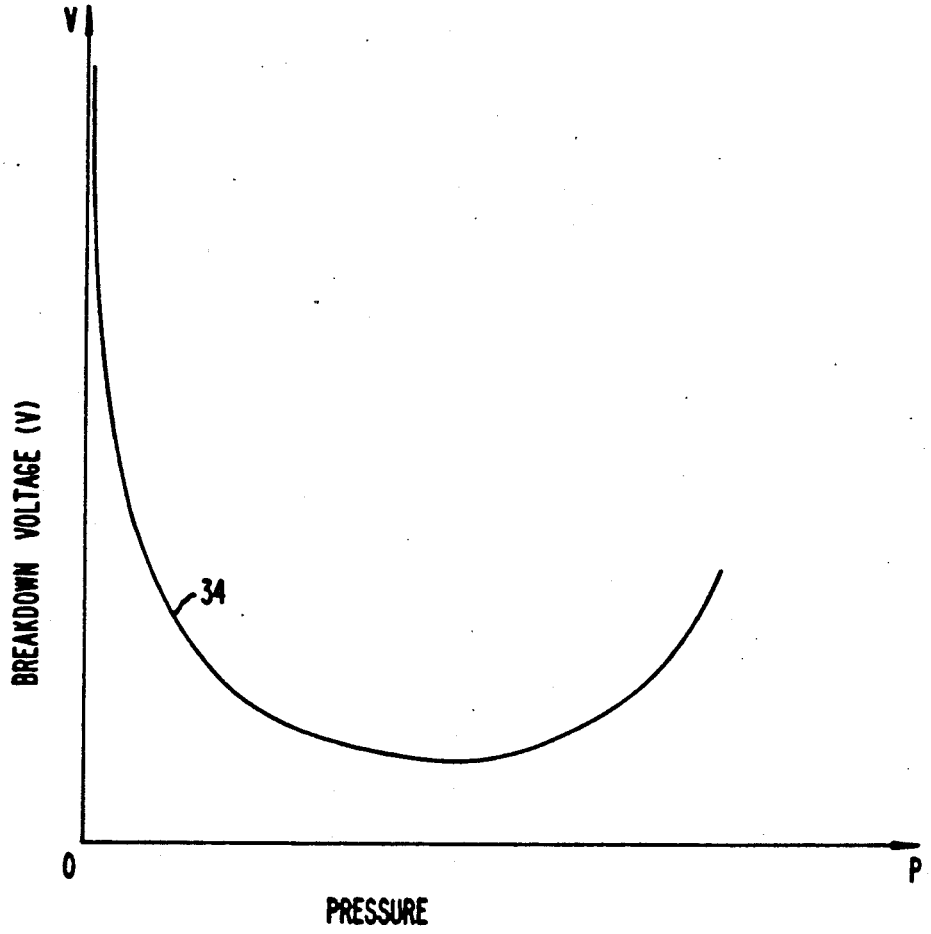
FIG. 3 is a graph of gap breakdown voltage verses pressure.

Because interior 48 consists of a vacuum, the ambient pressure inside housing 46 remains constant and substantially equal to zero. From the graph in FIG. 3, the breakdown voltage of gap 50 in a vacuum is essentially infinite. Current will only pass from contact 42 to contact 44 when the switch is closed mechanically. Current will not pass from contact 42 to contact 44 by arcing. Therefore, an energy storage capacitor can discharge through vacuum interrupter 40 only when the vacuum interrupter switch is closed. Unlike an energy storage capacitor coupled to a spark gap tube, discharge of an energy storage capacitor coupled to vacuum interrupter 40 is governed by the opening and closing of an independently operated mechanical switch and does not occur automatically, as upon attaining the breakdown voltage of a spark gap. The dielectric properties of gap 50 therefore do not govern the discharge energy level and discharge timing of the capacitor. Thus, timing and energy levels can be independently controlled by selectively configuring the remaining ignitor circuit elements.

High Energy Ignitor Circuit System Overview

Figure 5:
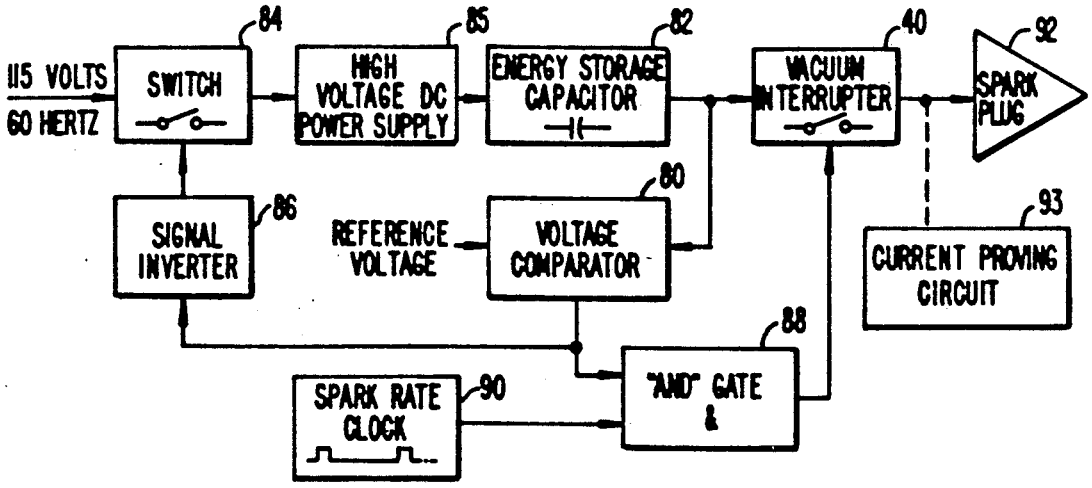
FIG. 5 shows a block diagram of a high energy ignitor circuit according to an embodiment of the present invention.

FIG. 5 contains a block diagram of a high energy ignitor utilizing a vacuum interrupter and control circuitry according to an embodiment of the present invention. The ignitor system comprises a voltage comparator 80 which is coupled to an energy storage capacitor 82 and to a reference voltage. When the voltage across energy storage capacitor 82 is below a value determined by the reference voltage of voltage comparator 80, voltage comparator 80 closes switch 84 via signal invertor 86. With switch 84 closed, the high voltage DC power supply 85 charges energy storage capacitor 82 until the voltage across capacitor 82 exceeds a value determined by the voltage comparator 80 reference voltage. When the voltage across energy storage capacitor 82 exceeds this predetermined value, an input is provided to an AND gate 88, and switch 84 opens, thereby discontinuing charging of energy storage capacitor 82.

A spark rate clock 90 determines the ignitor spark rate by providing a periodic output that enables AND gate 88. When both the output of voltage comparator 80 and the output of spark rate clock 90 are present at the input of AND gate 88, vacuum interrupter switch 40 closes. Closure of vacuum interrupter 40 transfers energy stored in energy storage capacitor 82 to the spark plug 92, generating a spark to ignite the fuel.

The ignitor circuit of the present invention may also contain a current proving circuit 93 to sense if current periodically flows through plug 92. Once current is proven fuel flow for ignition is initiated. The initial flow of fuel without an ignition source presents a dangerous situation. The output of the current sensing circuit is forwarded to a control center which monitors operations and prohibits initiation of fuel flow in the event no current flows to plug 92. Typically, once fuel is ignited the ignitor circuit is de-energized. Flame stability can be monitored and reported to the control center by separate combustion detectors.

Description of High Energy Ignitor System Operation and Components

Figure 6:
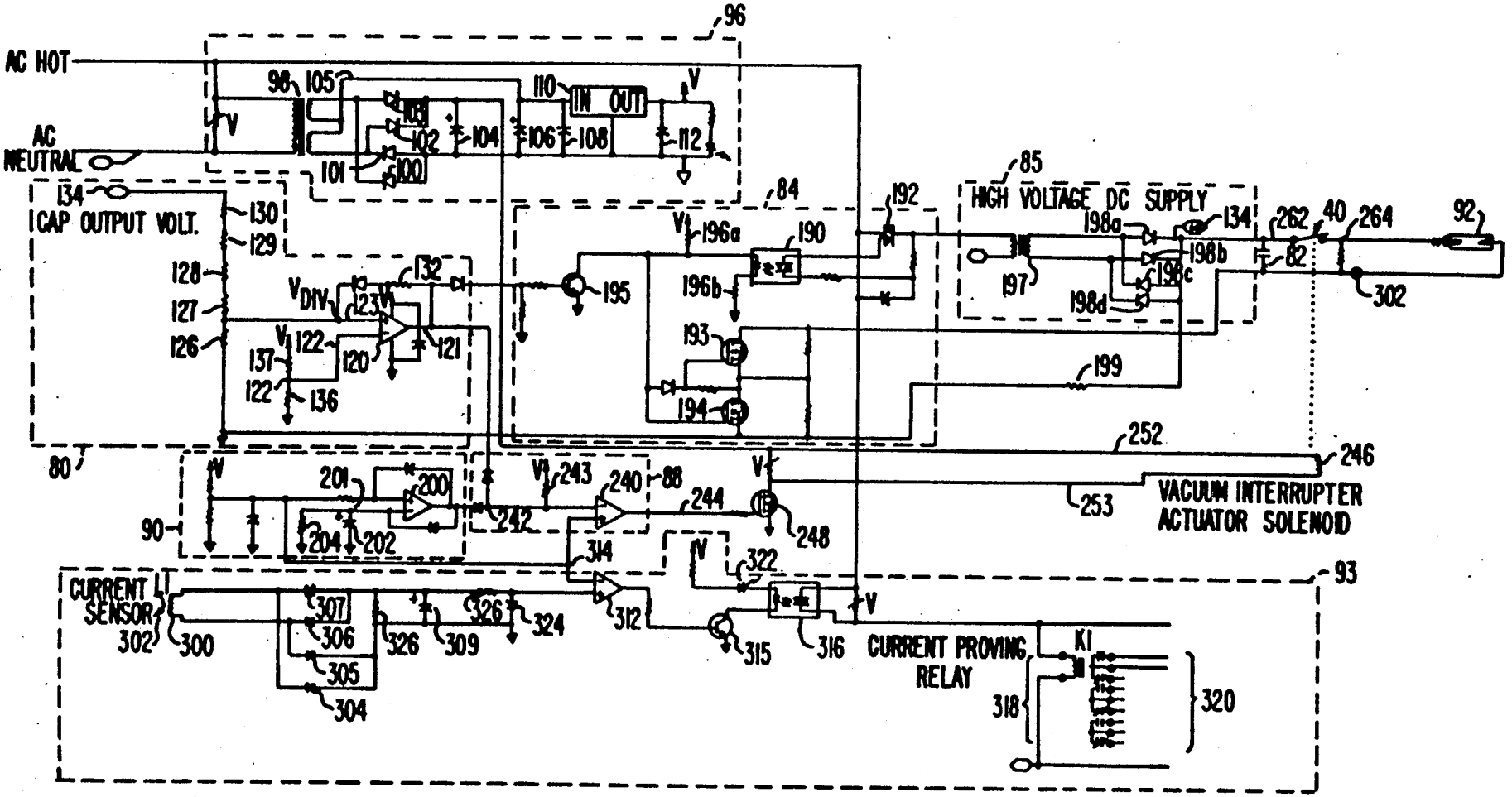
FIG. 6 shows a top level schematic of a high energy ignitor circuit according to an embodiment of the present invention.

FIG. 6 contains a top level schematic of an embodiment of the present invention. In the embodiment of FIG. 6, a single phase of AC line voltage is transformed to approximately 28 volts root mean square (rms) by a low voltage DC power supply 96 at the secondary of transformer 98. Diodes 100–103 are configured to form a full wave bridge circuit. The DC output of the bridge circuit is filtered by capacitor 104, to provide an unregulated 28 VDC for operation of the device which effects mechanical closure of vacuum interrupter switch 40. The center top 105 of transformer 98 output is filtered by capacitors 106 and 108 and regulated to 12 volts by voltage regulator 110 and capacitor 112. The 12 volt DC output of power supply 96 powers the remaining elements of the circuit.

Operational amplifier 120 is configured to form voltage comparator 80. The level of energy stored in energy storage capacitor 82 is determined by the voltage comparator reference voltage. When the potential across energy storage capacitor 82 is below a value determined by the reference voltage of voltage comparator 80, charging switch 84 is closed and high voltage DC power supply 85 charges capacitor 82. Capacitor 82 has been charged to the desired level when the potential across energy storage capacitor 82 exceeds a value determined by the reference voltage of voltage comparator 80. Charging switch 84 is then opened to halt charging of capacitor 82.

A fixed reference voltage may be used to establish a stable and fixed discharge energy for storage capacitor 82. A fixed reference voltage is easily obtained using any number of known circuit designs. In the schematic of FIG. 6, voltage comparator 120 comprises an output node 121, an inverting input 122 and a noninverting input 123. Output node 121 is coupled to switching circuit 84. Noninverting input 123 is coupled to a voltage divider circuit consisting of resistors 126–130 and feedback resistor 132. The noninverting input is further coupled to energy storage capacitor 82 at node 134. The potential of energy storage capacitor 82 thus appears at noninverting input 123 as $V_{div}$ which is a known function of resistors 126–130 and 132. Inverting input 122 is coupled to resistors 136 and 137 which are coupled to $V_{cc}$ and ground respectively to present a fixed reference voltage ($V_{ref}$) at node 122.

Figure 7:
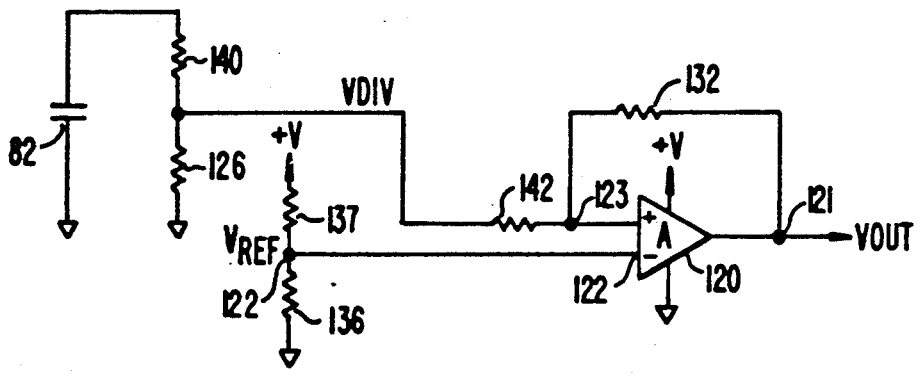
FIG. 7 shows a schematic of a voltage divider circuit used to establish the voltage across an energy storage capacitor according to an embodiment of the present invention.

FIG. 7 diagrams a variation of the voltage divider circuit depicted in FIG. 6. In this circuit resistors 127–130 are represented as a single resistor 140 and a resistor 142 has been added in series. As will be apparent to those of ordinary skill in the art, a large number of circuit designs can be used to establish a fixed reference voltage and a corresponding range of fixed discharge energy levels for capacitor 82.

In many high energy ignitor applications, however, a variable, user-selected, discharge voltage is desireable to accommodate changed operating conditions or a worn spark plug 92. The energy stored in storage capacitor 82 before discharge, can be increased by increasing the voltage comparator 80 reference voltage 122. Conversely, the energy stored in storage capacitor 82 can be decreased by decreasing the voltage comparator 80 reference voltage.

Figure 8:
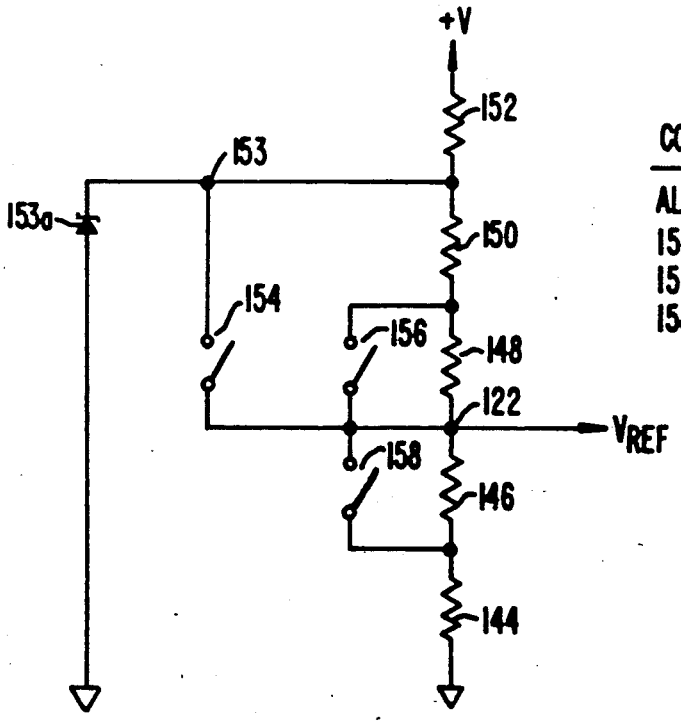
FIG. 8 shows a schematic of a circuit which permits the selection of one amongst several predetermined energy levels in the energy storage capacitor according to an embodiment of the present invention.

FIG. 8 contains one circuit embodiment suitable for selecting from among several possible reference voltages. In FIG. 8, resistors 144–152 are connected in series and coupled to ground and to $V_{cc}$. The output of the circuit at node 122 equals $V_{ref}$. The circuit is also coupled to ground via node 153 through Zener diode **153*a*. Switches 154, 156 and 158 remove resistors 146, 148, and 150 from the series network by closing the switch to create a short circuit around the resistor(s). The table associated with the schematic of FIG. 8 shows an example of how energy storage levels for capacitor 82 can be varied by opening and closing switches 154–158** for a given set of resistor values.

So long as the input signal $V_{div}$ is slightly less than the voltage $V_{ref}$, energy storage capacitor 82 is not at the desired potential. Under these conditions, the output signal appearing at node 121 is deasserted and switching circuit 84 remains closed. With switching circuit 84 closed, high voltage DC power supply 85 charges energy storage capacitor 82. Once $V_{div}$ becomes slightly larger than $V_{ref}$, capacitor 82 is at the desired potential. The output signal at node 121 is asserted and switching circuit 84 opens thereby discontinuing charging of capacitor 82.

Switching circuit 84 comprises an optically coupled triac driver 190 which operates triac 192; two enhancement mode MOS transistors 193 and 194; and NPN transistor 195. Optically coupled triac driver 190 and triac 192 operate as an AC switch to open and close the capacitor charging circuit. Use of an optically coupled triac driver isolates the high voltage level circuitry from the lower voltage circuitry in the remainder of the circuit. When voltage comparator 80 asserts the signal to open the charging switch, NPN transistor 195 becomes conductive. Resistors **196*a* and 196*b* operate as signal inverter 86, such that, once NPN transistor 195 turns on, optically coupled triac driver 190 turns off and shuts down triac 192, thereby halting the charging of capacitor 82 from power supply 85**.

Operation of the AC switch, however, requires a zero point crossing of the AC waveform before effecting the switch opening or closing. This requirement can cause a delay of over 8 milliseconds before switch 84 opens. During the delay, capacitor 82 continues to charge beyond the desired energy level. For these reasons, a faster DC switch consisting of transistors 193 and 194 connected in series is also provided. Transistors 193 and 194 are coupled to the secondary of the high voltage power supply 85 transformer 197. When NPN transistor 195 turns on, transistors 193 and 195 turn off preventing charging of capacitor 82 until such time as the AC switch fully activates.

Transformer 197 and diodes 198*a–d* comprise high voltage power supply 85 used to charge energy storage capacitor 82 through resistor 199 when switch 84 closes. Transformer 197 receives the AC line voltage and converts to a higher voltage for conversion to DC through diodes 198*a–d*. Because the spark rate is determined by spark rate clock 90 and not by the time required for high voltage DC power supply 85 to charge energy storage capacitor 82 to the breakdown voltage of the gap as in conventional ignitor circuits, the spark rate is unaffected by AC line voltage variations. High voltage DC power supply 85, therefore, need not be regulated in order to obtain a constant spark rate as is the case with prior art high energy power units. For these reasons, the expensive ferroresonant transformers of the conventional ignitor circuit are not required and transformer 197 can consist of a less expensive simple transformer. Optionally, however, if independent timing of the spark rate via spark rate clock 90 is not desired, spark rate can be determined by the time necessary to charge capacitor 82 to the desired voltage. In such a system, power supply 85 must be regulated to account for AC line voltage variations.

In the embodiment of FIG. 6, however, operational amplifier 200 is configured to form spark rate clock 90 for independent timing of the ignitor system. Any number of known circuit designs may be used. In this embodiment, amplifier 200 is a free running oscillator. The inverting input 201 of operational amplifier 200 is coupled to a capacitor 202 connected in parallel with resistor 204. Resistor 204 controls the discharging of capacitor 202 and thus the oscillation of the circuit. To adjust the spark rate clock frequency, the value of resistor 204 can be altered by configuring resistor 204 as a variable resistor or by substituting a resistor of a different value. Decreasing the resistance of resistor 204 increases the speed with which capacitor 202 discharges and thus increases the spark rate.

The spark rate established by the spark rate clock can be varied over a wide range. At one extreme the spark rate can have a period of a fortnight or more. At the other extreme the spark rate is limited by the reaction time of the solenoid actuation device used to close the vacuum interrupter. In typical applications the spark rate will have a frequency on the order of eight hertz.

Operational amplifier 240 is configured as AND gate 88. When either voltage comparator 80 or spark rate clock 90 signals are not asserted, the signal asserted by resistor 243 is overridden. When both voltage comparator 80 and spark rate clock 90 output signals are asserted and present at node 242, the output 244 of AND gate 240 is deasserted and signals activation of vacuum interrupter 40. Activation of vacuum interrupter 40 causes capacitor 82 to discharge and fire plug 92. Optionally, AND gate 88 can be omitted and activation of vacuum interrupter 40 can be governed solely by the output of the spark rate clock. Such an arrangement would produce a constant spark rate ignitor but not constant energy ignition.

Activation of vacuum interrupter 40 is effected by a solenoid 246 which is controlled by MOS transistor 248. Vacuum interrupter 40 is held in the open circuit position when Solenoid 246 is energized. When the output of AND gate 88 is deasserted, in response to signals from spark rate clock 90 and voltage comparator 80, MOS transistor 248 stops conducting and deenergizes solenoid 246. Deenergizing solenoid 246 closes vacuum interrupter 40. Energy storage capacitor 82 then discharges through vacuum interrupter 40 and fires plug 92. Alternatively, a triac and optically coupled triac driver may be used to deenergize solenoid 246 and close vacuum interrupter 40.

Figure 9B:
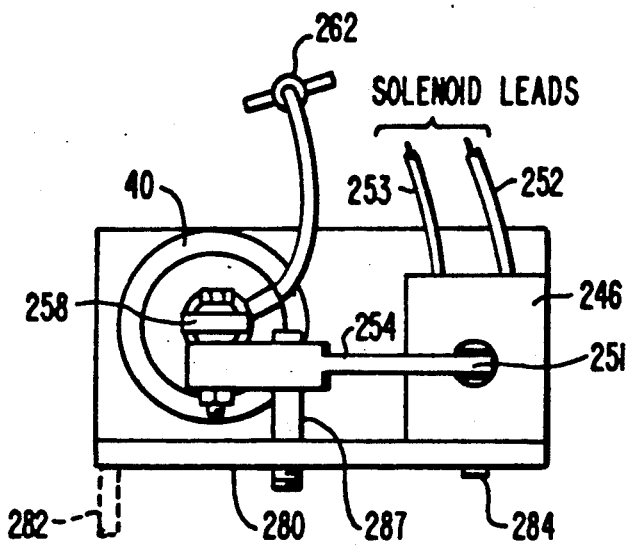
FIG. 9B shows an end view of a vacuum interrupter solenoid activation assembly according to an embodiment of the present invention.
Figure 9A:
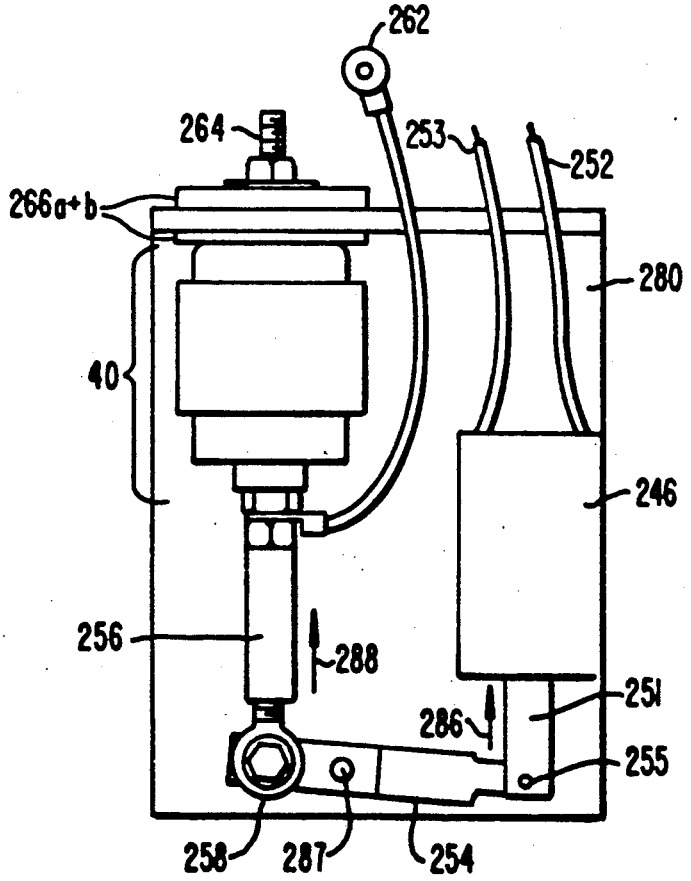
FIG. 9A shows a top view of a vacuum interrupter solenoid activation assembly according to an embodiment of the present invention.

FIGS. 9A and 9B contain a top and end view, respectively, of a vacuum interrupter solenoid actuation device assembly suitable for use in the present invention. Solenoid 246 comprises a solenoid and plunger assembly 251 with conical taper configured for DC operation. Two leads, 252 and 253 connect solenoid 246 to the remainder of the ignitor circuit. Plunger 251 connects to one end of a lever arm 254 with tension pin 255. The other end of lever arm 254 connects to the vacuum interrupter insulated actuating rod 256 via swivel rod end 258. Actuating rod 256 is fabricated from insulating material. A flexible lead 262 couples terminal 42 of vacuum interrupter switch 40 (shown in FIG. 4) to energy storage capacitor 82. Terminal 44 (also shown in FIG. 4) of vacuum interrupter switch 40 couples to spark plug 92 from the output stud 264. Two insulating washers 266*a* and 266*b* insulate output stud 264. The entire actuation assembly is mounted on a steel plate 280, which may include a tab 282 for mounting. Alternatively, plate 280 may be secured to a mounting surface with tapped holes or the like. Solenoid 246 attaches to plate 280 with mounting screws 284.

When solenoid 246 is energized, vacuum interrupter 40 is held in the open position. Plunger 251 is drawn in the direction of arrow 286, which causes lever arm 254 to pivot on pivot pin 287, causing swivel rod end 258/insulated actuating rod 256 to move in a direction opposite arrow 288 via the lever arm linkage. The terminals of vacuum interrupter 40 are thereby separated by a gap 50, as shown in FIG. 4, and the switch is open. Vacuum interrupter 40 is held in this open configuration so long as solenoid 246 remains energized.

When solenoid 246 deenergizes in response to the signal from AND gate 88, the force holding vacuum interrupter 40 in the open position is released. Plunger 251 moves in a direction opposite to arrow 286. This motion of plunger 251 causes lever arm 254 to pivot about pivot post 287. Atmospheric pressure acting upon interrupter 40 terminal 42 in the direction of arrow 288 pulls on actuating rod 256, allowing terminal 42 of vacuum interrupter 40 to come into contact with terminal 44. Energy contained in capacitor 82 is then immediately conveyed from input lead 262 across the terminals and output to spark plug 92 via output stud 264. Mechanical bounce of the switch is not a problem with this apparatus since the discharge of energy across the terminals takes place before bounce rebound occurs.

The embodiment of FIG. 6 also includes a safety feature to ensure that current flows from capacitor 82, through vacuum interrupter 40 and into plug 92. Current proving circuit 93 comprises an inductance coil 300 which senses spark plug current at node 302. The inductance coil must be located on a wire which carries only spark plug 92 current. Inductance coil 300 outputs a voltage which is rectified by a full wave bridge circuit comprised of diodes 304–307 and converted to a DC voltage by capacitor 309. This DC voltage is supplied to the noninverting input 311 of operational amplifier 312. Operational amplifier 312 is configured as a voltage comparator having its inverting input tied to a reference voltage at node 314. When the DC voltage at node 311 exceeds the reference voltage at node 314 the output of operational amplifier 312 is asserted and causes a transistor 315 to become conductive. Transistor 315 then turns on optically coupled triac and triac driver 316, which in turn activates current proving relay 318. Terminals 320 of relay 318 connect to various user system control circuits (not shown) which monitor combustion operations. A light emitting diode 322 lights whenever triac 316 is activated to indicate that spark plug current has been proven.

Energy acquired during the brief spark plug discharge period is stored in capacitor 309, diode 322 and resistor 324 form a circuit to protect OPams 312 noninverting input 311 from excessive (damaging) voltages. Resistor 326 sets a time constant (with capacitor 309) for how often the plug must fire. This fact allows the current proving system to verify and not merely infer that current in fact passes through the plug. In addition, the current sensing scheme of the ignitor of the present invention disposes with the complicated and expensive components necessary in conventional circuits to sense and process the voltage fluctuations of the energy discharge capacitor. The current proving circuit of the present invention therefore permits a reduction in cost of the relay and requires only the inclusion of a simple inductance coil 300 to sense plug 92 current.

Description of High Energy Ignitor Operation Using Illustrative Example

The operation and advantages of the ignitor system of the present invention are best illustrated by way of an hypothetical combustion engineering application. For example, a newly installed ignitor plug is used in conjunction with the ignitor circuit of the present invention to fire an aircraft jet engine. The aircraft ferries passengers from Denver to Miami during the winter months. During the first flight, an engine flameout occurs and the engine must be restarted. The new plug of this example requires that energy discharge capacitor 82 supply only 8 joules of energy to fire the plug. As the plug is subjected to repeated firings, the energy demands of the plug increase until finally, the high cycle plug requires a 12 joule setting to fire. Towards the end of the plug's expected life, but prior to a routine maintenance replacement, the plug incurs a fault which prevents the plug from firing. In addition, the AC line voltage supplied by the engine compressor can vary $\pm 10\%$.

In the hypothetical airplane example, the discharge energy of storage capacitor 82 of the ignitor would be set at 10 joules by maintenance personnel when the new plug is installed. To set the ignitor system of the representative embodiment to the desired energy level, maintenance technicians close switch 158 as described in FIG. 8. At a later date, the energy level can be changed by maintenance personnel to the 12 joules necessary to account for the high cycle plug by closing switch 156 in FIG. 8.

Figure 10:
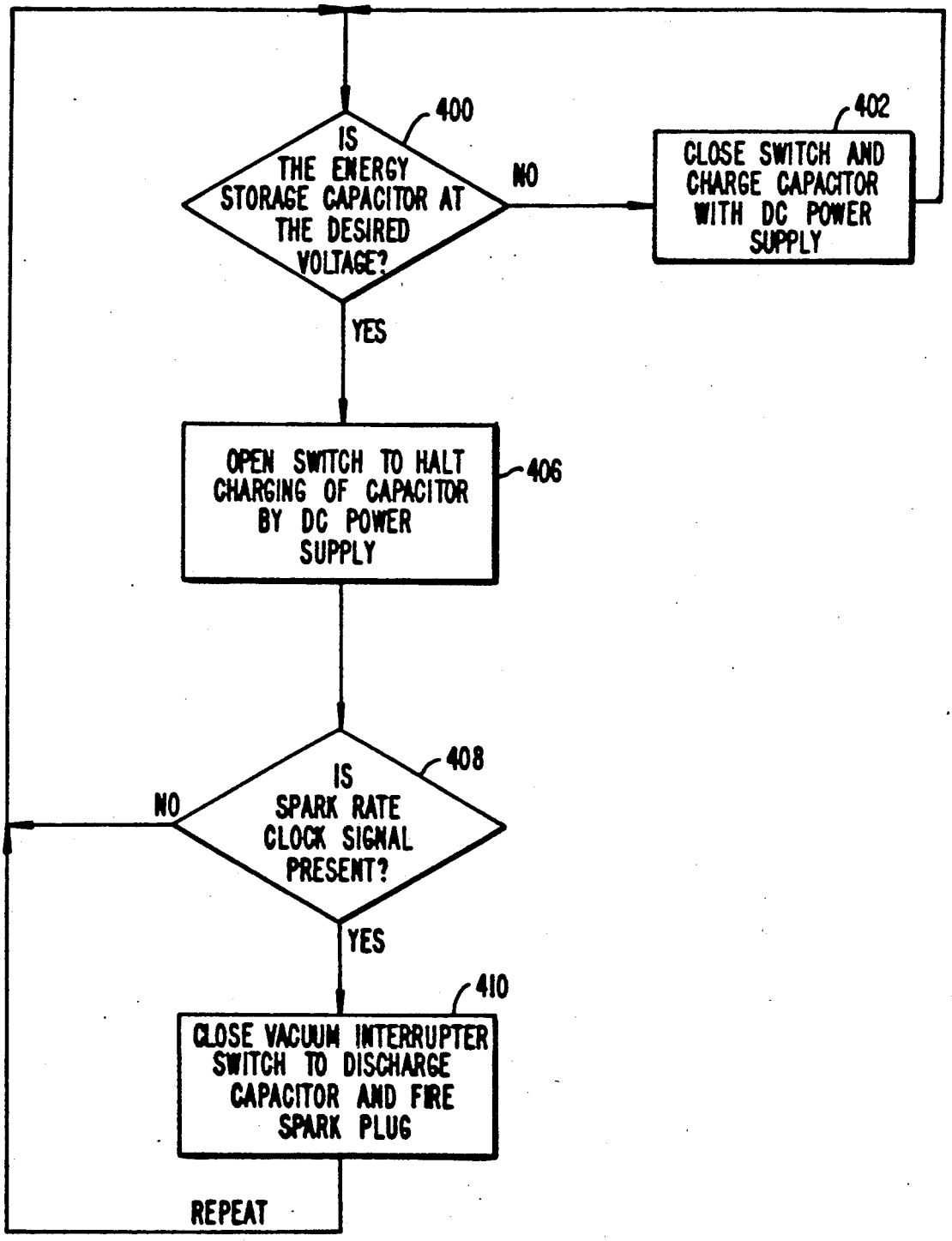
FIG. 10 shows a flow chart which describes the logical operation of an embodiment of an ignitor circuit of the present invention.

FIG. 10 contains a flow chart which summarizes the logical operation of the embodiment of the high energy ignitor system as described above during operation of the aircraft engine. In the first logical operation step 400, the potential of energy storage capacitor 82 is checked against the preestablished reference voltage necessary to discharge the desired 8 joules of energy. If capacitor 82 is not at the desired energy level, the output of voltage comparator 80 initiates step 402 causing charging switch 84 to close (or remain close). High voltage DC power supply 85 charges capacitor 82 to the desired level.

Once energy storage capacitor 82 is charged to the desired level, the output of voltage comparator 80 causes the charging switch to open and halts charging of the capacitor in step 406.

The signal output by voltage comparator 80 to halt charging of capacitor also appears at AND gate 88. In step 408, AND gate 88 ANDs the voltage signal with the signal from spark rate clock 90. Spark rate clock 90 is set according to the spark rate necessary to start the aircraft engine. If both the spark rate clock signal and the voltage comparator signal are asserted, then in step 410, a signal is forwarded to solenoid 246, closing the vacuum switch and sending current into spark plug 92 causing it to fire. The spark appearing at plug 92 ignites the fuel and the engine starts.

During the airplane flight, the ignitor circuit experiences severe changes in operating conditions due both to the extreme differences in the winter climates in Miami and Denver and also due to altitude temperature changes as the plane travels along its flight path. When the engine flames out during the flight, the ignitor system must respond consistently to ignite the fuel and restart the engine. In conventional ignitor systems, the breakdown voltage of spark gap tube 20 varies in response to these changes in operating environment. As the breakdown voltage varies, the energy stored in the energy storage capacitor before discharge drifts away from the desired energy level of 8 joules. Furthermore, since the spark rate of a conventional ignitor system is determined by the time needed to charge the energy storage capacitor to the breakdown voltage of gap 30 of spark gab tube 20, the spark rate fluctuates as the breakdown voltage varies.

Unlike conventional ignitors, the ignitor system of the present invention is unaffected by these drastic changes in operating conditions. Because interior 48 of vacuum interrupter 40 is evacuated, the breakdown voltage of gap 50 remains infinite despite these changes in climatic conditions. Capacitor 82 therefore cannot discharge until voltage comparator 80 determines, in step 400, that capacitor 82 is at the desired energy level. The discharge energy of the capacitor remains constant at the desired 8 joules throughout the trip.

The climatic changes also do not affect the spark rate, since spark rate is controlled by spark rate clock 90. Before the plug is fired in step 410, a clock signal must be present in step 408. Nonetheless, even in the absence of a spark rate clock, spark rate would be unaffected since the time needed to charge the capacitor to the fixed energy level of 8 joules would remain constant if a regulated voltage supply 85 were used to account for the $\pm 10\%$ variations experienced in the AC line voltage.

The ignitor system of the present invention, however, does not require that power supply 85 be regulated to account for the line voltage variations experienced during flight. Any fluctuation in the charging time of capacitor 82 caused by these voltage variations is small compared with the period of the spark rate clock.

Therefore, the ignitor system spark rate is insensitive to any line voltage variations experienced and remains constant at the desired rate throughout the trip. The ignitor system of the present invention can therefore deliver the same constant energy, constant spark rate performance during flight to restart the engine as on the ground.

According to the example, after several trips to and from Miami, the now high cycle spark plug fails. When this failure occurs, current no longer flows through the plug. Current proving circuit 93 therefore no longer senses current in the spark plug wire. Current proving relay 318 then forwards a signal to the flight engineer and/or pilot who can then either request specific engine maintenance or engage a backup ignitor system to prevent a possible internal explosion of the engine in the event of relighting an in-flight flameout.

As is apparent from the foregoing, the present invention provides a high energy ignitor circuit with constant spark rate and constant energy. Furthermore, a feature improvement provides an indication of circuit operation with a higher degree of integrity. Presently preferred embodiments of the present invention have been described. Variations and modifications will be readily apparent to those skilled in the art. For example, variable resistors can be used to control the spark rate clock and vary the reference voltage of the comparator circuit. In addition, a number of power supply designs known to those skilled may be used.

What is claimed is:

1. An ignitor system for firing a spark plug comprising:

an energy storage device;

means, coupled to said energy storage device, for monitoring a quantity of energy stored in said energy storage device and for issuing a control signal when a given quantity of energy is stored in said energy storage device;

a vacuum interrupter switch having first and second terminals wherein said first terminal is coupled to said spark plug, and said second terminal is coupled to said energy storage device; and means, coupled to said means for monitoring and to said vacuum interrupter switch, for closing said vacuum interrupter switch when said control signal is asserted;

whereby when said vacuum interrupter switch closes said given quantity of energy is transferred from said energy storage device to said spark plug.

2. The ignitor system of claim 1 wherein the means for closing the vacuum interrupter switch comprises a solenoid.

3. The ignitor system of claim 1 further comprising a regulated DC power supply for supplying energy to said energy storage device.

4. The ignitor system of claim 1 wherein the energy storage device comprises a capacitor.

5. The ignitor system of claim 1 wherein the means for monitoring and issuing a control signal comprises a voltage comparator.

6. The ignitor system of claim 1 further comprising:

means, coupled to said spark plug, for sensing a current through said spark plug; and means, coupled to said means for sensing a current, for indicating when no current is sensed by said means for sensing current.

7. An ignitor system for firing a spark plug comprising:

an energy storage device;

means, coupled to said energy storage device, for monitoring a quantity of energy stored in said energy storage device and for issuing a first control signal when a given quantity of energy is stored in said energy storage device;

a first switch, coupled to said means for monitoring a quantity of energy in said energy storage device, which disconnects said energy storage device from a supply of energy when said first control signal is asserted;

a clock for issuing a second control signal;

a vacuum interrupter switch, having first and second terminals wherein said first terminal is coupled to said spark plug and said second terminal is coupled to said energy storage device; and means, coupled to said means for monitoring a quantity of energy, to said clock, and to said vacuum interrupter switch, for closing said vacuum interrupter switch when both said first and second control signals are asserted, and thereby transfer said given quantity of energy from said energy storage device to said spark plug.

8. The ignitor system of claim 7 further comprising a means for supplying energy to said energy storage device.

9. The ignitor system of claim 8 wherein said means for supplying energy comprises an unregulated DC power supply.

10. The ignitor system of claim 7 wherein the energy storage device comprises a capacitor.

11. The ignitor system of claim 7 wherein the means for monitoring a quantity of energy stored in said energy storage device comprises a voltage comparator.

12. The ignitor system of claim 7 further comprising:

means, coupled to said spark plug, for sensing a current through said spark plug; and means, coupled to said means for sensing a current, for indicating when no current is sensed by said means for sensing current.

13. The ignitor system of claim 7 wherein the means for closing said vacuum interrupter switch comprises a solenoid device.

14. An ignitor system for firing a spark plug comprising:

an energy storage capacitor for storing a quantity of energy;

at least a first DC power supply, coupled to an AC line voltage and to said energy storage capacitor for converting said AC line voltage to DC power and supplying energy to said energy storage capacitor;

a vacuum interrupter switch, having first and second terminals, wherein said first terminal is coupled to said spark plug and said second terminal is coupled to said energy storage capacitor;

a voltage comparator, coupled to said energy storage capacitor and to a reference voltage, for issuing a first control signal when a quantity of energy stored in said energy storage capacitor exceeds a given amount;

a switch, coupled to said voltage comparator and disposed between said energy storage capacitor and said DC power supply, for decoupling said DC power supply from said energy storage capacitor when said first control signal is issued;

a spark rate clock for outputting a second control signal; and means, coupled to said spark rate clock, to said voltage comparator and said vacuum interrupter switch, for closing said vacuum interrupter switch when both said first and second control signals are asserted and to thereby transfer said quantity of energy stored in said energy storage capacitor to said spark plug.

15. The ignitor system of claim 14 further comprising:

means, coupled to said spark plug for sensing a current through said spark plug; and means, coupled to said means for sensing a current, for indicating when no current is sensed by said means for sensing current.

16. The ignitor system of claim 15 wherein:

said means for sensing a current comprises an inductor coil; and said means for indicating when no current is sensed comprises a relay.

17. The ignitor system of claim 14 further comprising a second DC power supply which powers said ignitor system.

18. The ignitor system of claim 14 wherein said first DC power supply is unregulated.

19. The ignitor system of claim 14 wherein said means for closing said vacuum interrupter switch comprises a solenoid.

20. The ignitor system of claim 19 further comprising:

an AND gate, having an input which receives said first and second control signals, and an output coupled to said solenoid which outputs a third control signal to control operation of said solenoid.

21. The ignitor system of claim 14 wherein said reference voltage can be selected from among a first range of values to correspondingly select a quantity of energy stored in said energy storage capacitor from among a second set of values.

22. The ignitor system of claim 14 wherein said spark rate clock comprises a free running oscillator.

23. A method for igniting a fuel using a spark plug comprising the steps of:

using a power supply to charge an energy storage device;

disconnecting said energy storage device from said power supply when a given quantity of energy is stored in said energy storage device;

generating a first control signal when said given quantity of energy is stored in said energy storage device;

generating a clock signal; and closing a vacuum interrupter switch to discharge said given quantity of energy into said spark plug when said first control signal and said clock signal are generated.

24. The method for igniting a fuel of claim 23 further comprising the step of:

selecting said given quantity of energy stored in said energy storage device from an available set of energy levels.

25. The method for igniting a fuel of claim 23 further comprising the step of:

selecting a clock signal frequency.

26. A method for igniting a fuel using a spark plug comprising the steps of:

using a power supply to charge an energy storage device;

disconnecting said energy storage device from said power supply when a given quantity of energy is stored in said energy storage device;

generating a first control signal when said given quantity of energy is stored in said energy storage device; and given quantity of energy into said spark plug when said first control signal is generated.

27. The method for igniting a fuel of claim 26 further comprising the step of:

selecting said given quantity of energy stored in said energy storage device from an available set of energy levels.

28. The method of igniting a fuel of claim 26 further comprising the step of regulating said power supply.

* * * * *

UNITED STATES PATENT AND TRADEMARK OFFICE

CERTIFICATE OF CORRECTION

PATENT NO. : 5,049,786

DATED : 9/17/91

INVENTOR(S) : Ted Gotisar, et al

It is certified that error appears in the above-identified patent and that said Letters Patent is hereby corrected as shown below:

Col. 1, line 19, "Capacitor(s) lo" should read --Capacitor(s) 10--

Col. 6, line 30, "$V_{cc.}$" should read --$V_{cc}$.--

Col. 6, line 31, "$V_{ref.}$" should read --$V_{ref}$.--

Col. 10, line 7, "remain close" should read --remain closed--

Col. 10, line 41 "gab" should read --gap--

Col. 14, line 31, --closing a vacuum interrupter switch to discharge said-- should be inserted after "and"

Signed and Sealed this

Sixteenth Day of February, 1993

*Attest:*

STEPHEN G. KUNIN

*Attesting Officer*

*Acting Commissioner of Patents and Trademarks*